United States Patent [19]

Gage

[11] Patent Number: 4,705,172

[45] Date of Patent: Nov. 10, 1987

[54] LID WITH ORIENTATION DEVICE

[75] Inventor: Jeffrey C. Gage, Beaverton, Oreg.

[73] Assignee: Gage Industries, Inc., Lake Oswego, Oreg.

[21] Appl. No.: 879,480

[22] Filed: Jun. 27, 1986

[51] Int. Cl.[4] ..... B65D 21/02; B65D 41/16; B65D 43/03

[52] U.S. Cl. ..... 206/519; 220/306; 220/380

[58] Field of Search ..... 206/519, 520; 220/380, 220/353, 306; 229/2.5 R

[56] References Cited

U.S. PATENT DOCUMENTS

| | | | |
|---|---|---|---|
| 3,303,964 | 2/1967 | Luke | 206/519 |
| 3,389,851 | 6/1968 | Clark | 206/380 |
| 3,620,411 | 11/1971 | Rump | 229/2.5 R |

*Primary Examiner*—George E. Lowrance

[57] ABSTRACT

An improved stackable lid design for placement onto a container by automated processing machinery is disclosed. The design includes an alignment notch extending into a rim portion of the lid. The notch serves to keep individual lids in a stack of such lids in proper rotational alignment. The notch also enables a user to properly orient a stack of such lids within the processing machinery. The notch can be sized to receive an end user's finger for effecting removal of the lid from the container.

3 Claims, 5 Drawing Figures

LID WITH ORIENTATION DEVICE

BACKGROUND OF THE INVENTION

This invention relates generally to stackable lids and more particularly to stackable lids which are placed onto food containers by automated processing machinery.

Many ready-to-cook foods, such as prepackaged frozen foods, are available in microwave usable containers or plates having plastic lids fitted thereto. Such prepackaged foods are generally prepared by the manufacturer utilizing automated processing machinery which fills the containers with food, places the lids thereon, and packages the final product for freezing.

The lids commonly have notches in their rims extending about the rim periphery which provide interior locking projections to provide a snap fit of the lid to a container. Stacks of such lids are placed into in-feed bins accessible by the automated processing machinery for placement of the lids onto the containers. The lids are individually pulled from the stacks by the machinery and snap fit onto the containers. The lids are fit onto the containers in such a way that one of the locking projections is snap-locked onto the container last. The lids must be grasped by the machinery in the proper orientation so that the last projection to be fit to the container is in a predetermined position relative to the machinery. Accordingly, the lids in a given stack must be rotationally aligned with respect to the other lids and, the stack of aligned lids must be properly aligned within the in-feed bins. This will assure that the lids are taken from the stack by the machinery in the proper rotational orientation so that the one locking projection is snap-locked onto the container last.

If the stacks of lids are not properly oriented in the in-feed bins, the processing machinery is not able to snap fit the lid onto the container. When this happens, somewhere downstream in the processing line, the lid falls away from the container causing the machinery to jam or food to be dislodged from the container. This requires the process line to be shut down and may also require extensive cleaning of the machinery. Such disruptions in the process are time consuming and expensive.

Lids of the prior art are held in rotational alignment in a stack of lids by ribbing. The side walls of such lids have a ribbed and grooved outer surface which mate with the ribs and grooves in the two adjacent lids in a stack. However, the ribs do not securely keep the lids in rotational alignment. For example, it is easy for a lid to become rotationally offset from the other lids by one or more ribs. When this happens, the misaligned lid might not be properly fit onto a container resulting in the lid becoming dislodged and disrupting the process line. It is very difficult for a person to detect such a misaligned lid within a stack of lids.

Assuming the lids are all rotationally aligned within a stack, the stack itself must be rotationally aligned within the in-feed bin of the machinery. Presently, persons responsible for placing stacks of lids into the in-feed bins align the stacks by reference to an arrow or other stamped indicia on the top of the lids. A person focuses on this indicia on the lid at the top of the stack and accordingly places the stack so that the machinery grasps the lids in proper alignment. However, the arrow or other indicia is difficult to see and accordingly, makes it difficult to properly align the stacks of lids.

SUMMARY OF THE INVENTION

Accordingly, it is an object of the present invention to provide a stackable lid which won't readily become rotationally misaligned in a stack of such lids.

Another object of the present invention to provide a stackable lid which better enables a user properly to orient a stack of such lids into an in-feed bin of processing machinery which places the lids onto containers.

Yet another object of the present invention is to provide such a lid which snap fits to a container to remain secured thereto.

Still another object of the present invention is to provide such a lid which is easily removable by an end user.

The foregoing and other objects, features and advantages of the present invention will become more readily understood from the following detailed description which proceeds with reference to the accompanying drawings.

DETAILED DESCRIPTION

Figure 1:
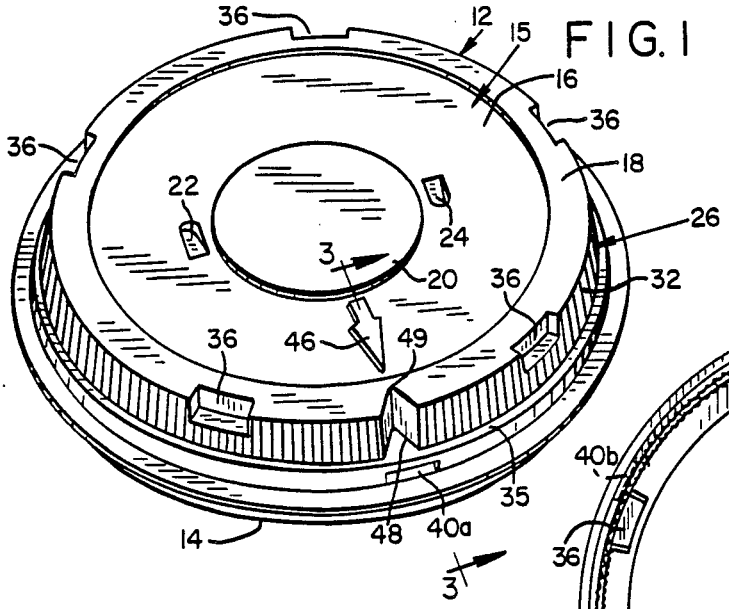
FIG. 1 is an elevation perspective view of a lid in accordance with the invention attached to a container.
Figure 2:
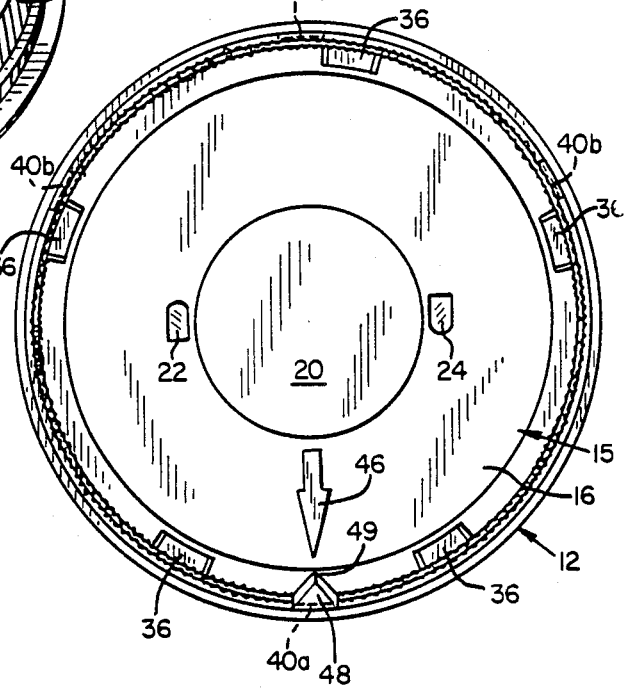
FIG. 2 is a top view of the lid of FIG. 1.

Referring first to FIGS. 1 and 2, a circular lid 12 constructed in accordance with the invention is shown snap fitted to a lower container 14 for storing and cooking frozen foods. The lid 12 includes an upper cover portion 15 having an annular recessed portion 16, an annular outer-edge raised portion 18, and a circular inner raised portion 20. Slots 22, 24 are provided in the recessed portion 16 adjacent the center raised portion 20 to provide pressure relief as the frozen food cooks. The lids are formed by thermoforming a thermoplastic material to conform to the desired shape.

Figure 3:
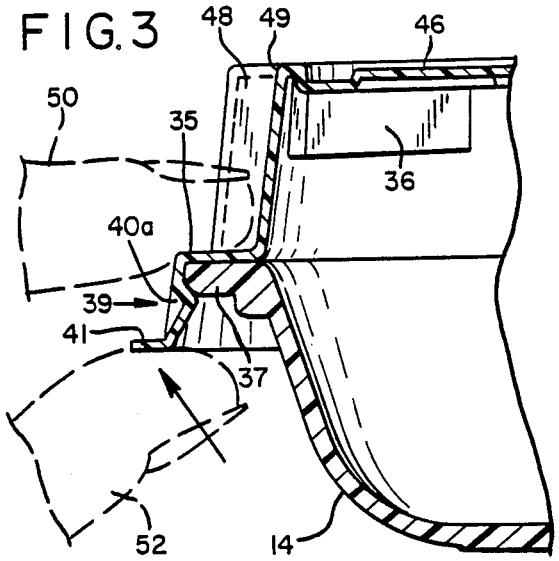
FIG. 3 is an enlarged sectional view taken along line 3—3 in FIG. 1, an end user's finger and thumb being shown in phantom.
Figure 4:
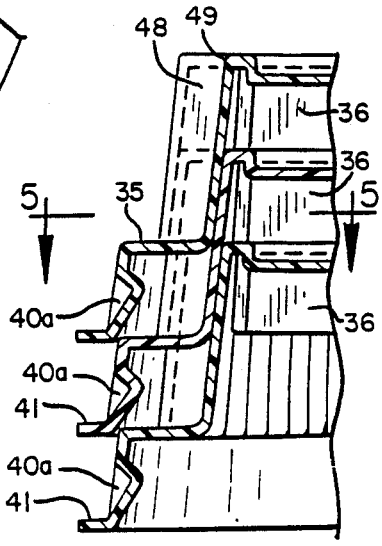
FIG. 4 is a fragmentary sectional view of a stack of lids in accordance with the invention.

A rim portion 26 extends downwardly from the raised outer-edge 18 of the upper cover portion 15 and is continuous therewith. The rim portion 26 includes a ribbed upper sidewall portion 32 which is inclined outwardly at a small angle to facilitate stacking of the lids as shown in FIG. 4. Extending horizontally outwardly from the lower edge of the sidewall 32 is a lip 35 adapted to sit upon the ledge like rim 37 of the container 14 as shown in FIG. 3. Extending downwardly from the lip 35 is a skirt 39, the lower edge of which is flared outwardly as indicated at 41 to stiffen the skirt and provide a surface which may be conveniently engaged by the user to remove the lid from the container.

A plurality of stacking protuberances 36 are formed on the upper sidewall portion 32 and cover portion 15 for enabling easy separation of adjacent stacked lids. Referring to FIG. 4, the stacking protuberances 36 extend inwardly of the sidewall portion 32 and engage upon the edge portion 18 of the next lower lid in a stack.

Figure 5:
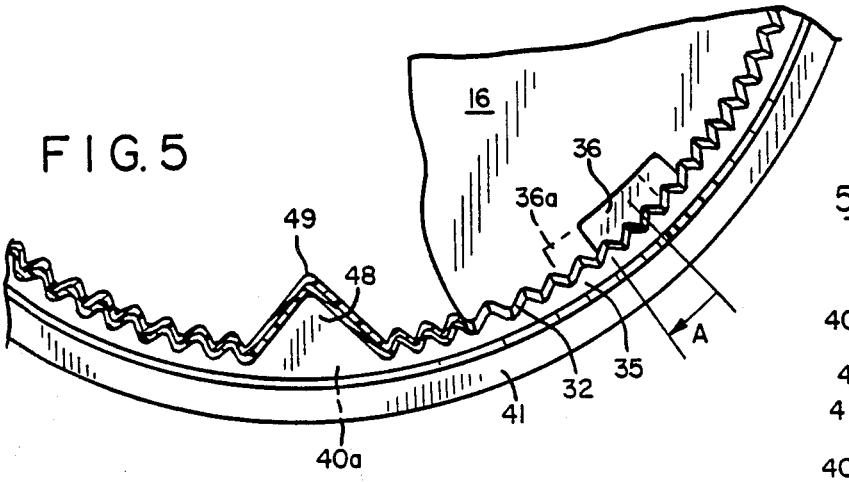
FIG. 5 is a fragmentary sectional view taken along line 5—5 in FIG. 4.

The lids are manufactured in two slightly different designs to enable the stacking protuberances 36 properly to function. The two designs differ solely in the angular position of the stacking protuberances 36, the stacking protuberances 36*a* of one design being slightly offset by a small angle 'A' from those of a second design, as best shown in FIG. 5. The lids are stacked with the lids of the two designs alternating. Thus, protuberances 36 and 36*a* partially overlap one another in a stack of lids so that the protuberances of each lid will engage upon the edge surface 18 of the next lower lid, as best shown in FIG. 4, rather than meshing with the protuberance of the lower lid if the protuberances were uniformly positioned. This positions the lower, outer flared edges 41 of the lids further apart facilitating synchronization and removal of the lids from a stack.

A plurality of locking projections 40*a*, 40*b* are formed in the skirt 39 and arranged to snap fit beneath the rim 37 of the container 14, as shown in FIG. 3, to secure the lid to the container. As shown, three of the locking projections 40*b* are positioned in one half of the cover skirt 39 while a single locking projection 40*a* is placed centrally in the opposite half of the skirt. The locking projection 40*a* is adapted to be snap fit onto the container last by the automated processing machinery. In so doing, the machinery first places the half of the cover 12 having the three projections 40*b* onto the container at an angle which positions projections 40*b* beneath the container rim 37. The machinery then pushes the other half of the lid onto the container and snap fits the projection 40*a* over the rim 37. As will be readily apparent, if the stack of lids is not properly positioned so the machinery grasps the lid in the proper rotational orientation, the projection 40*a* will not be the last portion of the cover 12 forced onto the container. When this happens, not all of the projections 40*a*, 40*b* snap fit beneath the rim 37 which leads to dislodging of the lid from the container somewhere further down the process line. Heretofore, an arrow such as arrow 46 pointing toward the projection 40*a* has been provided for the user to detect for proper orientation of a stack of the lids. However, such arrows are visually hard to detect and misalignment of the lids has too frequently occurred.

In accordance with the present invention a triangular alignment notch 48 is provided in the sidewall portion 32, preferably with the inner apex 49 of the notch in radial alignment with the projection 40*a*. The alignment notch 48 has three valuable functions. It provides a means for positively stacking the lids in alignment with another so that the notch 40*a* of each lid will be properly positioned in the processing machinery. It also provides a visual means for the machinery operators easily to detect the rotational orientation of a stack of such lids for proper placement of the stack into the in-feed portion of the automated processing machinery by focusing on the notch 48 in the lid at the top of the stack and thus properly place the lids in the in-feed portion. The notch 48 also enables the lid more easily to be removed from the container 14 by a consumer as will be described below. The notch need not be triangular and could have another shape.

It is preferable that the alignment notch 48 extends into the rim portion a sufficient distance to receive a finger 50 of an end user's hand, while another finger 52 is engaged beneath the flare 41. By raising the flare 41 while pressing down with the other finger, the projection 40*a* is moved outwardly free of the container rim 37 so that the lid can be peeled off the container in the reverse order from which it was placed onto the container. This enables a consumer to easily detach the lid from the container without distorting the lid or contents of the container.

As illustrated, the alignment notch 48 is positioned over the last locking projection to be fit to the container, locking projection 40*a*. The notch 48 could also be placed over one of the other projections or positioned elsewhere on the rim. The notch should be large enough to provide a suitable mechanical locking means to prevent adjacently stacked lids from rotating with respect to one another in a stack. The notch should also be large enough to be readily perceptible to serve as a visual alignment means for proper orientation of a stack of such lids. It would not, of course, necessarily have any usefulness in removing the lid from a container in such an instance.

It should be readily apparent that the foregoing lid could be adapted to be used with non-food containers as well.

Having illustrated and described the principles of my invention with reference to one preferred embodiment, it should be apparent to those persons skilled in the art that such invention may be modified in arrangement and detail without departing from such principles. I claim as my invention all such modifications as come within the true spirit and scope of the following claims.

I claim:

1. A stackable lid for placement onto a container by automated processing machinery, the container having a flat peripheral ledge-like rim, the lid comprising:

an upper cover portion;

a rim portion continuous with the cover portion including a sidewall portion extending downward from the cover portion, a ledge portion for engaging said container rim, and a skirt portion adapted to extend downwardly around said container rim;

a plurality of inwardly extending stacking projections formed in said sidewall portion;

a plurality of locking projections on said skirt adapted to engaged beneath said container rim; and an alignment notch formed in said sidewall portion positioned directly above one of the locking projections, the alignment notch providing mechanical alignment means for rotationally aligning individual lids within a stack of such lids, the alignment notch providing visual means for enabling a user easily to detect the rotational orientation of a stack of such lids for a user's proper placement of a stack of the lids into a lid infeed portion of the automated processing machinery for preventing the processing machinery from becoming jammed due to misaligned lids.

2. The apparatus of claim 1 wherein the alignment notch is sized to receive a digit of a human hand for effecting removal of the lid from the container.

3. A stackable lid for placement onto a container by automated processing machinery, the container having a flat peripheral ledge-like rim, the lid comprising:

an upper cover portion;

a rim portion continuous with the cover portion including a sidewall portion extending downward from the cover portion, a ledge portion for engaging said container rim, and a skirt portion adapted to extend downwardly around said container rim;

a plurality of inwardly extending stacking projections formed in said sidewall portion;

a plurality of locking projections on said skirt adapted to engage beneath said container rim, said plurality of locking projections being at least three in number, the first two of said at least three locking projections being positioned in one of the halves of the lid, the third of said at least three locking projections being centrally placed in the second half of the lid; and an alignment notch formed in said sidewall portion and positioned above the third locking projection, the alignment notch being sized to receive a digit of a human hand for effecting removal of the lid from the container, the alignment notch providing mechanical alignment means for rotationally aligning individual lids within a stack of such lids, and the alignment notch providing visual means for enabling a user easily to detect the rotational orientation of a stack of such lids for a user's proper placement of the stack into a lid infeed portion of the automated processing machinery for preventing the processing machinery from becoming jammed due to misaligned lids.

* * * * *